US007740399B2

(12) United States Patent
Simmons et al.

(10) Patent No.: US 7,740,399 B2
(45) Date of Patent: Jun. 22, 2010

(54) DRY CHEMICAL FEEDER FOR A CHEMICAL MIXING SYSTEM

(75) Inventors: David G. Simmons, Ft. Myers, FL (US); Ashok Vellaiah Retnaswamy, West Lebanon, NH (US)

(73) Assignee: Pulsafeeder, Inc., Rochester, NY (US)

( * ) Notice: Subject to any disclaimer, the term of this patent is extended or adjusted under 35 U.S.C. 154(b) by 431 days.

(21) Appl. No.: 11/825,417

(22) Filed: Jul. 5, 2007

(65) Prior Publication Data

US 2008/0144429 A1 Jun. 19, 2008

Related U.S. Application Data

(60) Provisional application No. 60/818,787, filed on Jul. 6, 2006.

(51) Int. Cl.
*B01F 15/02* (2006.01)

(52) U.S. Cl. ..... 366/153.1; 366/155.1; 366/162.1; 366/181.3

(58) Field of Classification Search ..... 366/151.1, 366/155.1–158.4, 152.1, 152.2, 152.4, 153.1, 366/152.6, 167.1, 131–134, 160.2, 162.1, 366/181.1, 181.3, 183.1, 190, 182.4
See application file for complete search history.

(56) References Cited

U.S. PATENT DOCUMENTS 3,456,801 A * 7/1969 Bowles ..... 210/123
3,957,253 A * 5/1976 Barton et al. ..... 366/132
4,436,429 A * 3/1984 Strong et al. ..... 366/2
4,820,053 A * 4/1989 Rivers ..... 366/137
5,222,807 A * 6/1993 Gaddis ..... 366/339
5,344,619 A * 9/1994 Larwick et al. ..... 422/261
5,580,168 A * 12/1996 Alireza et al. ..... 366/153.1
5,951,161 A * 9/1999 Blagg ..... 366/152.6
6,039,470 A * 3/2000 Conwell ..... 366/137
6,592,246 B2 * 7/2003 Maree ..... 366/132
7,147,361 B2 * 12/2006 Cecala et al. ..... 366/132
2006/0000849 A1 * 1/2006 Simmons et al. ..... 222/1
2008/0144429 A1 * 6/2008 Simmons et al. ..... 366/142

FOREIGN PATENT DOCUMENTS

JP 62125830 A * 6/1987

* cited by examiner

*Primary Examiner*—Charles E Cooley
(74) *Attorney, Agent, or Firm*—Hodgson Russ LLP

(57) ABSTRACT

A feeder system comprising a hopper for holding dry chemical. A feed tube extends from the hopper and is for delivering dry chemical to a mixing tank. A first solenoid actuator is provided for controlling the opening and closing of a first solenoid actuated gate that is disposed in the feed tube. A second solenoid actuator is provided for controlling the opening and closing of a downstream second solenoid actuated gate disposed in the feed tube. A central controller is provided that is in communication with and controls the system components including the introduction of the dry chemical and process water into the mixing tank. The central controller controls a metering pump that pumps chemical mixed solution out of the mixing tank.

14 Claims, 1 Drawing Sheet

DRY CHEMICAL FEEDER FOR A CHEMICAL MIXING SYSTEM

CROSS REFERENCE TO RELATED APPLICATION

Figure 1:
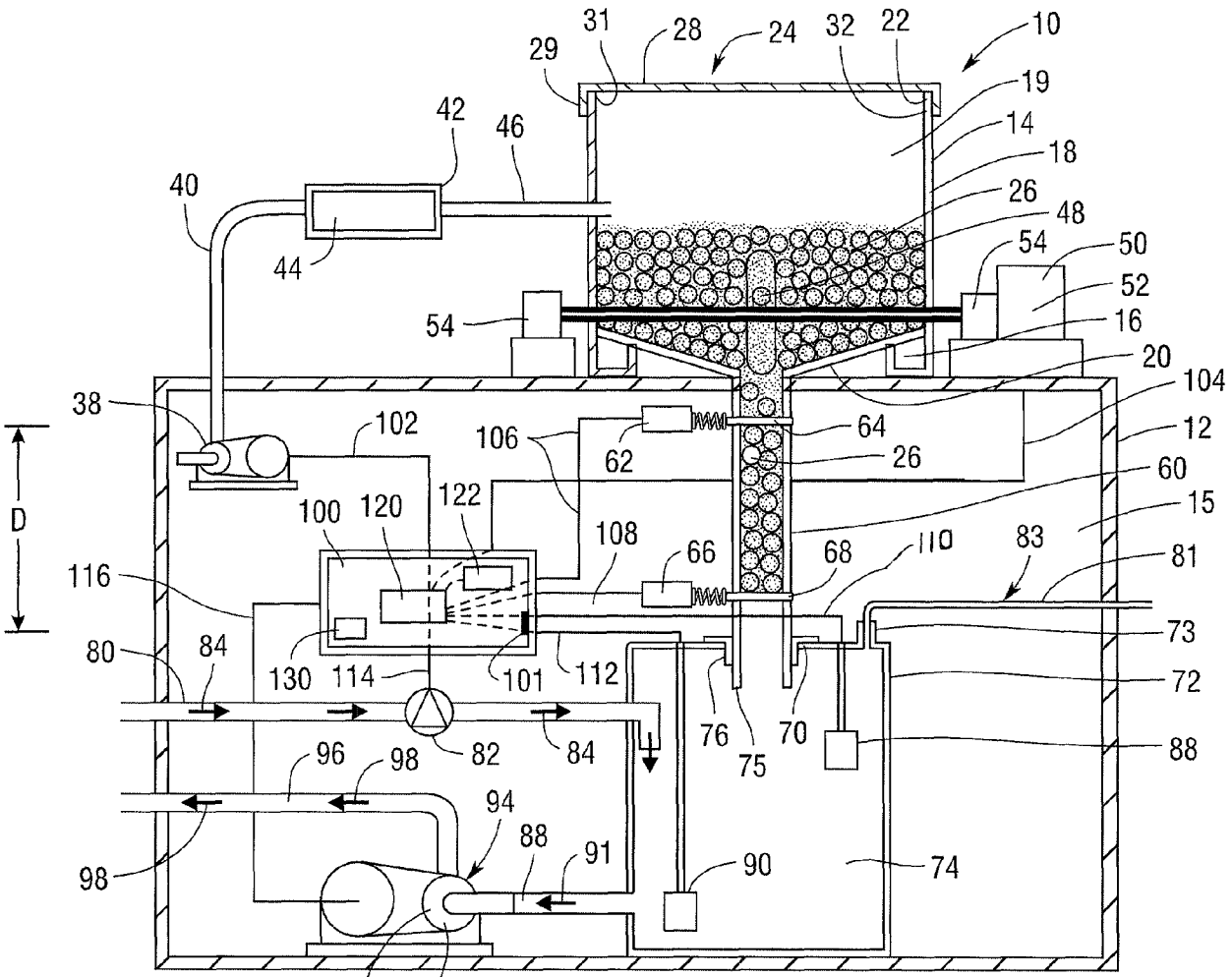

This application claims priority to United States Provisional patent application having Ser. No. 60/818,787, filed Jul. 6, 2006 to Simmons et al., for a Dry Chemical Feeder System, the contents of which are hereby incorporated by reference.

BACKGROUND

Feeder systems may be employed to ensure smooth flow of solid particles into a process environment. Feeder systems may be used in bulk solids handling, for example in the paper and pulp industries. Another use of feeder systems is to dispense desired amounts of dry chemicals. The terminology "dry chemical" may be used to refer to a chemical that is stored and handled in a solid state and in any shape. The dry chemical can have the shape of a sphere or cylinder, or may be in a powder form. In addition, some chemicals are unstable when in a liquid state and therefore need to be stored and handled in solid state. Hopper systems may lack consistency in delivering the precise quantity of dry chemical into a "wet" system, because clogging may occur in the hopper spout where the dry chemical meets the wet system.

Thus, it would be desirable if there was an economical hopper system to convert dry chemicals in a solid state into a liquid solution, while maintaining precision and consistency.

SUMMARY

The dry chemical feeder system consistently dispenses a precise amount of dry chemical into a process system. The dry chemical is converted into a liquid solution by the dry chemical feeder system, and the liquid solution may be directly pumped into a "wet" system. The dry chemical feeder system includes a hopper with an impeller disposed therein and an airtight lid. The hopper is mounted on a housing to allow for indoor or outdoor usage of the dry chemical feeder system. A feed tube extends from the hopper into the housing, and the feed tube has first and second solenoid actuated gates disposed therein. The feed tube extends into a mixing tank having high and low liquid level sensors disposed therein, a vent, an inlet and an outlet. A solenoid valve controls the flow of incoming process water into the mixing tank. The second solenoid actuated gate opens to allow the dry chemical to fall into the mixing tank. A metering pump pumps the chemically mixed water out of the mixing tank. A central controller is provided that communicates control signals to the feeder system components such that the dry chemical and process water are consistently and precisely mixed.

An air pump may be provided to blow air or other gas through a desiccant cartridge into the hopper to ensure that atmosphere internal to the hopper is dry and has a low humidity level. The low humidity level serves to reduce the moisture induced degradation of the dry chemical, which may be cylindrical, spherical or pellet shaped, or may be in the form of a powder. It is pointed out that the air pump and desiccant are used if dry air is not readily available at the facility or factory. In addition, virtually any source of dry air may be used to replace the air pump and desiccant, for example the factory may have a source of dry air.

The above-mentioned components of the dry chemical feeder system are actuated and controlled by the central controller, which includes a microprocessor and memory. The operation of the system occurs in a specific timed sequence to achieve precise consistent feeding of the dry chemical. In the sequence or cycle described below, time is indicated by the capital letter T and the Arabic numeral following the letter T indicates the sequence of steps as time progresses. For example, T1 indicates events occurring at the beginning of the process, T5 indicates events occurring during the middle of the process, and T8 indicates events occurring at the end of the overall process.

Time=T1: Start of chemical loading event:

a) The central controller sends a signal to a first solenoid actuator and the first solenoid actuator is energized and the first solenoid actuated gate controllably opens.

b) The central controller sends a signal to a motor and the impeller begins to rotate.

Time=T2: End of chemical loading event:

a) The central controller sends a signal to the first solenoid actuator and the first solenoid actuator is de-energized and the first solenoid actuated gate is closed.

b) The central controller sends a signal to the motor and turns the motor off and the impeller stops rotating.

Time=T3: Start of chemical dispense event:

a) The central controller sends a signal to the second solenoid actuator and the second solenoid actuator is energized and the second solenoid actuated gate opens. The dry chemical flows through the feed tube into the mixing tank.

Time=T4: End of chemical dispense event:

a) The central controller sends a signal to the second solenoid actuator and it is de-energized and the second solenoid actuated gate is closed.

Time=T5: Start of process water inlet event:

a) The central controller sends a signal to the solenoid valve and the solenoid valve is controllably opened which allows process water to flow through a process inlet water pipe and into the mixing tank.

Time=T6: End of process water feed event:

a) The water flows into the mixing tank and reaches a high liquid level sensor which causes a signal to be sent to the central controller.

b) The central controller sends a signal to the solenoid valve such that the solenoid valve is turned off and the flow of water into the mixing tank stops.

Time=T7: Start of liquid chemical feed event:

a) The central controller sends a signal to the metering pump and the metering pump is turned on. The liquid in the mixing tank, i.e., chemical mixed solution is pumped out of the mixing tank and flows through the mixing tank outlet pipe and out through the pump outlet pipe.

Time=T8: End of liquid chemical feed event:

a) The central controller receives a signal transmitted from the low liquid level sensor which indicates the level of chemical mixed water in the mixing tank has reached a predetermined low level.

b) The central controller then sends a signal to the metering pump and the metering pump is turned off.

The above-described sequence or cycle repeats itself automatically or ends depending on the control signals outputted by the central controller 100. Or, the process repeats itself based on the user requirements or inputs to the central controller 100 from the user.

One of the advantages of the dry chemical feeder system is that it provides for converting the dry chemical that is in solid state into a chemical mixed solution that can be precisely injected into a wet process system (not shown) by the metering pump. Another advantage is that the feed tube does not clog.

BRIEF DESCRIPTION OF THE DRAWING FIGURE

FIG. 1 is a sectional view of the dry chemical feeder system.

DESCRIPTION

The dry chemical feeder system 10 (also referred to herein as system 10) is shown in FIG. 1. The feeder system 10 includes a housing 12 having a housing interior 15, and a hopper 14 having a base 16 is mounted on the housing 12. The hopper 14 has a surrounding wall portion 18 that is joined to a tapered portion 20 which narrows in a direction toward the housing 12. The surrounding wall portion 18 extends to an edge 22 that defines a hopper opening 24. The hopper 14 has a hopper interior 19. The hopper 14 is covered by a removable lid 28 from which extends a mounting wall 29, and the mounting wall 29 is sized to fit around the hopper 14. The lid 28 is supported on the edge 22 of the hopper 14 and covers the hopper opening 24, such that when the lid 28 is supported on the hopper 14 an airtight seal 32 is formed. The lid 28 may have a gasket 31 for this purpose. Dry chemical 26 is introduced into the hopper 14 through the hopper opening 24 when the lid 28 is lifted off the hopper 14. As shown in FIG. 1, the hopper 14 is partly filled with dry chemical 26 which is embodied as a plurality of spheres. In other embodiments, the dry chemical 26 may be in the form of cylinders or powders and combinations thereof and the dry chemical 26 may include virtually any chemical required for the process.

An air pump 38 is disposed in the housing interior 15 and pumps atmospheric air through an air delivery pipe 40. The air delivery pipe 40 extends through the housing 12 and to a desiccant housing 42 having a desiccant cartridge 44 disposed therein. The atmospheric air is pumped through the desiccant cartridge 44 and dry air exits the desiccant cartridge 44 and flows through a dry air pipe 46 which extends through the hopper 14, such that the dry air is in fluid communication with the hopper interior 19. Dry air is continuously pumped into the hopper interior 19, and this advantageously prevents moisture induced degradation of the dry chemical 26 while it is stored in the hopper 14. The air pump 38 may be electrically powered and connected to a power source (not shown). Air pumps and desiccant cartridges are well known to those having ordinary skill in the art. It is pointed out that if a dry air source is readily available, for example at the factory, then the air pump 38 and desiccant cartridge 44 will not be needed and/or the dry air pump 38 will not need to be activated.

Disposed in the hopper interior 19 is an impeller 48 that is driven by a gear box 50 that is operatively associated with a motor 52, which may be an electric motor. The impeller 48 is supported by a pair of bearings 54, as shown in FIG. 1, such that it can be rotated when the motor 52 is energized. A feed tube 60 is joined to and extends from the tapered portion 20 of the hopper 14, and the feed tube 60 is for receiving dry chemical 26 that is caused to move through the feed tube by the impeller 40. There is a first solenoid actuator 62 for opening and closing a first solenoid actuated gate 64, and the first solenoid actuated gate 64 is disposed in the feed tube 60. In addition, there is a second solenoid actuator 66 for opening and closing a second solenoid actuated gate 68, and the second solenoid actuated gate 68 is disposed in the feed tube 60 downstream of the first solenoid actuated gate 64. The first and second solenoid actuated gates 64, 68, respectively, are placed or spaced from one another at a predetermined distance, designated D in FIG. 1. A volume is defined between the first and second actuated gates 64, 68, respectively. This volume may fill with the dry chemical 26 such that the amount of dry chemical 26, for example the number of spheres that are being fed into the feeder system 10, per cycle of the feeder system 10 is known. A cycle of the feeder system 10 will be described presently.

The other end of the feed tube 60 extends through an opening 70 in a mixing tank 72 such that the feed tube 60 terminates in the mixing tank interior 74 and ends at a feed tube end 75. The feed tube 60 is surrounded by a sealing member 76, for example a gasket, where it passes through the mixing tank 72. As shown in FIG. 1, the mixing tank 72 is positioned in the housing interior 15. The mixing tank 72 receives process water for the mixing process from a process water inlet pipe 80 that extends through the mixing tank 72. The process water inlet pipe 80 has a solenoid valve 82 through which the process water flows in the direction indicated by the arrows commonly designated 84.

There are high liquid level and low liquid level sensors 88, 90, respectively, disposed in the mixing tank interior 74. The high and low liquid level sensors 88, 90, respectively, may include floats. The high liquid level sensor 88 is positioned in an upper portion of the mixing tank 72, and the low liquid level sensor 90 is disposed in a lower portion of the mixing tank 72. It is pointed out that the feed tube end 75 is disposed above the high liquid level sensor 88. The mixing tank 72 has a safety vent 73 that is connected to a venting pipe 81 which is connected to a drain (not shown), thus eliminating any possible contact of the dry chemical 26 with the interior 15 of the housing 12 or other the components of the feeder system 10. In particular, as shown in FIG. 1, the high liquid level sensor 88 is disposed below the safety vent 73 and below the feed tube end 75, and the second solenoid actuated gate 68 is disposed above the safety vent 73 and venting pipe 81. The venting pipe 81 establishes a maximum backup level, designated 83 in FIG. 1, to which fluid from the mixing tank 72 may back up before it will flow out of the venting pipe 81 and out of the housing 12. Thus, the dry chemical 26 cannot enter the housing interior 15 and corrode or corrupt the electronics and components of the system 10, and the column of dry chemical 26 that is supported by the second solenoid actuated gate 68 remains dry at all times, regardless of downstream conditions. When the second solenoid actuated gate 68 is opened the dry chemical 26 flows into the mixing tank 72 and mixes with the process water in the mixing tank 72 to make the chemical mixed solution. It is pointed out that because the feed tube end 75 is disposed above the high liquid level sensor 88, the feed tube end 75 remains dry under normal operation of the system, and thus caking of chemical at the feed tube end is eliminated.

A metering pump 86 is disposed in the interior 15 of the housing 12 and is in fluid communication with the mixing tank 72. A mixing tank outlet pipe 88 extends from the mixing tank 72 to the metering pump 88. In particular, the mixing tank outlet pipe 88 extends though the mixing tank 72 and is connected to the inlet side 90 of the metering pump 86. The metering pump 86 draws the chemical mixed water through the mixing tank outlet pipe 88, as indicated by the arrow designated 92 in FIG. 1. The metering pump 86 pumps the chemical mixed water through the pump outlet 94 and through the pump outlet pipe 96 in the direction of the arrows indicated by 98. From there, the chemical mixed solution is pumped into a main process system (not shown) or wet process system (not shown), both of which are well known to those having ordinary skill in the art.

As shown in FIG. 1, the feeder system 10 includes a central controller 100 for controlling the above-described components, as shown in FIG. 1. The central controller 100 has a microprocessor 120 and is preprogrammed to receive and send signals to precisely control the components of the dry chemical feeder system 10. The microprocessor 120 is in communication with the components of the dry chemical feeder system and sends control signals to the components, and receives and interprets signals sent by the components. The microprocessor 120 is for executing computer program instructions and processing data. Central controllers and microprocessors are well known to those having ordinary skill in the art. The central controller 100 may have one or more memories 122 in which software is stored. The software may be used to program the microprocessor 120 to execute desired activities. The memories 122 can be used for storing information or data, process performance information or data, and information or data about control signals sent from the processor 100 to the system components. The system components under the control of the central controller 100 include the air pump 44, motor 52, first and solenoids actuators 62, 66, respectively, and associated first and second solenoid actuated gates 64, 68, respectively, the solenoid valve 82, metering pump 86 and the high and low liquid level sensors 88, 90, respectively. Process information may be communicated from the system components to the central controller, and corresponding control signals may be communicated from the central controller 100 to the system components. The central controller 100 processes incoming data from these components and determines if each of these components is reacting properly to the process operation parameters. The parameters of the control signals may be determined by the central controller 100 using software designed for analyzing the process information and selecting an appropriate corresponding control signal. The control signals may effect a change in the system components.

The central controller 100 may have a built in monitor 130 capable of displaying process operation parameters, operational parameters, process performance information, and information about the control signals sent from the controller 100 to the system components described above. The monitor 130 may be used to reprogram the central controller 100 by providing a graphical user interface that allows a person to select desired operational parameters for the metering system 10. Central controllers are well known to those having ordinary skill in the art.

An illustrative example of a central controller that can be used is described in U.S. Patent Publication Number US-2006-0000849-A1, having a Publication Date of Jan. 1, 2006 to Simmons et al., the contents of which are hereby incorporated by reference, which publication is based on pending U.S. patent application Ser. No. 11/110,160 filed on Apr. 20, 2005 to Simmons et al. the contents of which are hereby incorporated by reference, which application claims priority to provisional U.S. patent application Ser. No. 60/563,668 filed on Apr. 20, 2004, to Simmons et al., the contents of which are hereby incorporated by reference.

The central controller 10 is in communication with the system components. In particular, the air pump 36 is in communication with the central controller 100 and is capable of receiving control signals from the central controller 100. The signals from the central controller 100 to the air pump 36 may be carried through a wired or wireless communication channel 102. The central controller 100 is capable of controllably turning the air pump 36 on and off in accordance with the preprogrammed parameters stored in the microprocessor 120. Wired and wireless communication channels are well known to those having ordinary skill in the art.

The motor 52 that drives the impeller 48 is in communication with the central controller 100. The control signals from the central controller 100 to the motor 52 may be carried through a wired or wireless communication channel 104. The central controller 100 is capable of controllably turning the motor 52 on and off in accordance with the preprogrammed parameters stored in the microprocessor 120.

The first and second solenoid actuators 62, 68, respectively, are each in communication with the central controller 100. The control signals from the central controller 100 to each of the first and second solenoid actuators 62, 68, respectively, may be carried through wired or wireless communication channels 106, 108, respectively. The central controller 100 is capable of controlling the first and second solenoid actuators 62, 68, respectively, in accordance with the preprogrammed parameters stored in the microprocessor 120, in order to controllably open and close the first and second solenoid actuated gates 64, 68, respectively, to control the amount of dry chemical being delivered to the mixing tank 72.

The solenoid valve 82 is in communication with the central controller 100. The control signals from the central controller 100 to the solenoid valve 82 may be carried through a wired or wireless communication channel 114. The central controller 100 can control the incoming process water by controlling the opening and closing of the solenoid valve 82.

The high liquid level and low liquid level sensors 88, 90, respectively, are each in communication with the central controller 100 and the central controller 100 may have a receiver 101 for receiving the signals from the high and low liquid level sensors 88, 90, respectively. The signals from the high and low liquid level sensors 88, 90, respectively, sent to the central controller 100 are carried through wired or wireless communication channels 110, 112, respectively. The central controller 100 is capable of receiving and processing the incoming data received from the high and low liquid level sensors 88, 90, respectively, and analyzing the data to determine the level of liquid in the mixing tank 72 and effect a change in the process. When the high liquid level sensor 88 senses the liquid it transmits a signal to the central controller 100, and the central controller utilizes the information to effecting a change in the process, namely, to close the solenoid valve 82. This prevents the level of the fluid in the mixing tank from exceeding the predetermined level established by the high liquid level sensor 88 and from contacting the feed tube end 75. When the low liquid level sensor 90 detects a low liquid level it transmits a signal to the central controller 100, and the central controller 100 effects a change in the system 10 by sending a signal to the metering pump 86 causing the metering pump 86 to turn it off.

The metering pump 86 is in communication with the central controller 100. The control signals sent from the central controller 100 to the metering pump 86 may be carried through a wired or wireless communication channel 116.

In addition, the high and low liquid level sensors 88, 90, respectively, may be capable of sending an identification signal to the central controller 100. When the high and low liquid level sensors 88, 90, respectively, send the identification signal, the central controller 100 is capable of processing the identification signal to determine what type of process information will be provided and the form in which that information will be provided. For example, the high and low liquid level sensors 88, 90, respectively, may provide a code that can be matched to a table of codes stored in the memory 122. Once a match is found in the table, the central controller 100 is capable of accessing information necessary to interpret the information signal received from high and low liquid level sensors 88, 90, respectively. In this manner, the central controller 100 is capable of receiving the information signals from the high and low liquid level sensors 88, 90, respectively, and utilizing the information to provide a corresponding signal to the metering pump 86, and solenoid valve 82 to effect a change to the process.

To use, the operation of the feeder system 10 follows a predetermined sequence which is programmed into the central controller 100. A worker (not shown) loads the dry chemical spheres 26 into the hopper interior 19 while the first solenoid actuated gate 64 and the second solenoid actuated gate 68 remain in the closed position, and the first and second solenoid actuators 62, 66, respectively are de-energized. The removable lid 28 is fitted on the hopper 14 to form an airtight seal 32 between the removable lid 28 and hopper 14. The air pump 38 is turned to an on position to start supplying dry air to the hopper 14. From this point forward, the operation of the feeder system 10 follows the below described sequence or steps and the process may repeat itself. In addition, in the sequence described below, time is indicated by the capital letter T and the Arabic numeral following the letter T indicates the sequence of steps as time progresses. For example, T1 indicates events occurring at the beginning of the process, T5 indicates events occurring during the middle of the process, and T8 indicates events occurring at the end of the overall process.

Time=T1: Start of Chemical Loading Event a) The central controller 100 sends a signal to the first solenoid actuator 62 and the first solenoid actuator 62 is energized and the first solenoid actuated gate 64 controllably opens.

b) The central controller 100 sends a signal to the motor 52 and the impeller 48 begins to rotate.

Time=T2: End of Chemical Loading Event a) The central controller 100 sends a signal to the first solenoid actuator 62 and the first solenoid actuator 62 is de-energized and the first solenoid actuated gate 64 is closed.

b) The central controller 100 sends a signal to the motor 52 and turns the motor 52 off and the impeller 48 stops rotating.

Time=T3: Start of Chemical Dispense Event a) The central controller 100 sends a signal to the second solenoid actuator 66 and the second solenoid actuator 66 is energized and the second solenoid actuated gate 68 opens. The dry chemical 26 flows through the feed tube 60 into the mixing tank 72.

Time=T4: End of Chemical Dispense Event a) The central controller 100 sends a signal to the second solenoid actuator 66 and it is de-energized and the second solenoid actuated gate 68 is closed.

Time=T5: Start of Process Water Inlet Event a) The central controller sends a signal to the solenoid valve 82 and the solenoid valve 82 is controllably opened which allows water to flow through the process inlet water pipe 80 and into the mixing tank 72.

Time=T6: End of Process Water Feed Event a) The water flows into the mixing tank 72 and reaches the high liquid level sensor 88 which causes a signal to be sent to the central controller 100.

b) The central controller 100 sends a signal to the solenoid valve 82 such that the solenoid valve 82 is turned off and the flow of water stops.

Time=T7: Start of Liquid Chemical Feed Event a) The central controller 100 sends a signal to the metering pump 86 and the metering pump 86 is turned on. The liquid in the mixing tank 72, i.e., the chemical mixed solution is pumped out of the mixing tank 72 and flows through the mixing tank outlet pipe 88 and out the pump outlet pipe 96.

Time=T8: End of Liquid Chemical Feed Event a) The central controller 100 receives a signal transmitted from the low liquid level sensor 90 which indicates the level of mixed water and chemical in the tank 72 has reached a predetermined low level.

b) The central controller 100 sends a signal to the metering pump 86 and the metering pump 86 is turned off.

The above-described sequence or cycle repeats itself automatically or ends depending on the control signals outputted by the central controller 100 to the system components. Or, the process repeats itself based on the user requirements and/or inputs to the central controller 100 from the user.

One of the advantages of the dry chemical feeder system 100 is that it provides for converting the dry chemical 26 that is in solid state into a chemical mixed solution that may be precisely injected into the wet process system (not shown).

There are additional advantages of using the above described method for dry chemical 26 feeding, namely, the ability of the system 10 to contain the dry chemical 26, which may be very corrosive, from interacting with the electronics and other components of the dry chemical feeder system 10, for example the central controller 100. In addition, the feed tube 60 is directly connected to the mix tank 72 which has a safety vent 42 that is connected to a drain 73 thus eliminating any contact of the chemical 26 with the housing interior 15 or the above-described components of the feeder system 10, for example the central controller 100. In one of the embodiments the components of the feeder system 10 that come into contact with the dry chemical 26 or dry chemical mixed water are made from plastics to avoid any degradation.

In addition, the dry chemical feeder system 100 advantageously provides an easy to use, cost effective way to safely store, handle and dispense dry chemical 26 that is, for example corrosive, consistently and precisely into a "wet" process system (not shown). In other words, the system 10 dispenses a precise amount of dry chemical 26 into the mixing tank 72 and converts the dry chemical 26 and process water into a chemical mixed solution that can be controllably pumped into a "wet" process system (not shown) by the metering pump 86. This is accomplished by converting the chemical 26 into a chemical mixed solution the mixing tank 72, and then the liquid solution can advantageously be precisely and consistently injected into the "wet" system by the controller 100 controlling the rate that the metering pump 86 pumps the chemical mixed solution from the mixing tank 72 into the "wet" process system.

It is pointed out that in another embodiment the system can have one or no solenoid actuators and solenoid actuated gates, depending on factors including the shape of the chemical, the hopper design and user requirements.

It will be appreciated by those skilled in the art that while a dry chemical feeder system has been described above in connection with particular embodiments and examples, it is not necessarily so limited, and other embodiments, examples, uses, and modifications and departures from the embodiments, examples, and uses may be made within the scope and spirit of the dry chemical feeder system.

What is claimed:

1. A dry chemical feeder system for dispensing dry chemical and converting the dry chemical into a chemical mixed solution, the dry chemical feeder system comprising:

a hopper for receiving the dry chemical, a feed tube joined to the hopper, a mixing tank with the feed tube extending into the mixing tank, a first solenoid actuator operatively associated with a first solenoid actuated gate disposed in the feed tube, a second solenoid actuator operatively associated with a second solenoid actuated gate disposed in the feed tube below the first solenoid actuated gate, high and low liquid level sensors disposed in the mixing tank with the high liquid level sensor being disposed above the low liquid level sensor, a process water inlet pipe having a solenoid valve that is joined to the mixing tank for delivering process water to the mixing tank, a mixing tank outlet pipe joined at one end to the mixing tank and joined at the other end to a metering pump and the metering pump for pumping the chemical mixed solution out of the mixing tank through the mixing tank outlet pipe, and a central controller having a microprocessor in communication with and for sending command signals to the first and second solenoid actuators and the solenoid valve to control the delivery of dry chemical and process water into the mixing tank, and the central controller is in communication with the high and low liquid level sensors for receiving and processing information regarding the level of chemical mixed solution in the mixing tank, and the central controller is in communication with the metering pump to control the pumping of the chemical mixed solution out of the mixing tank based on signals received from the high and low liquid level sensors.

2. The dry chemical feeder system according to claim 1 further including an air pump and an air delivery pipe connected at one end to the air pump and connected to a desiccant housing having a desiccant cartridge disposed therein at the other end, and a dry air pipe connected to the desiccant cartridge at one end and connected to the hopper at the other end and the air pump for pumping dry air into the hopper.

3. The dry chemical feeder system according to claim 2 wherein the central controller is in communication with the air pump and is capable of sending a control signal to the air pump to turn the air pump on and off.

4. The dry chemical feeder system according to claim 1 further including an impeller disposed in the hopper for moving dry chemical into the feed tube, and a motor operatively associated with the impeller and the central controller in communication with the motor and capable of sending a signal to the motor to turn the motor on an off.

5. The dry chemical feeder system according to claim 1 wherein the feed tube has a feed tube end that is disposed above the first liquid sensor in the mixing tank.

6. The dry chemical feeder system according to claim 1 further including a lid fitted on the hopper to form an airtight seal to prevent moisture from entering the hopper.

7. The dry chemical feeder system according to claim 1 wherein a volume is defined between the first and second solenoid actuated gates and the feeder tube such that a predetermined amount of dry chemical enters the mixing tank through the feeder tube when the second solenoid actuated gate is caused to open by the central controller.

8. The dry chemical feed system according to claim 1 wherein the mixing tank include a vent that extends to a venting pipe and wherein the venting pipe is disposed below the second solenoid actuated gate such that the chemically mixed solution cannot back up to the level of the second solenoid actuated gate and wet the dry chemical.

9. A method for mixing dry chemical into a chemical mixed solution comprising:

providing a hopper with a feed tube, providing a mixing tank and extending the feed tube into the hopper, providing a first gate in the closed position and disposing the first gate in the feed tube, providing a second gate in the closed position and disposing the second gate in the feed tube at a position below the first gate, providing a mixing tank having high and low liquid level sensors disposed therein, providing a process water inlet pipe having a valve for delivering process water to the mixing tank and joining the process water inlet pipe to the mixing tank, providing a metering pump and a mixing tank outlet pipe and joining the mixing tank outlet pipe to the mixing tank and the metering pump, opening the first gate to dispense dry chemical from the hopper into the feed tube and closing the first gate, opening the second gate to dispense the dry chemical into the mixing tank, opening the valve to allow process water to flow into the mixing tank, closing the valve when the high liquid level sensor detects the chemically mixed solution, activating the metering pump and pumping the chemical mixed solution out of the mixing tank until the low liquid level sensor detects a low liquid level.

10. The method according to claim 9 further including providing an air pump in fluid communication with a desiccant cartridge and the hopper, that air pump for pumping air through the desiccant cartridge in order to supply dry air to the hopper.

11. The method according to claim 9 further including providing an impeller and disposing the impeller in the hopper and rotating the impeller in order to move dry chemical into the feed tube.

12. The method according to claim 9 further including providing the mixing tank with a vent and disposing the second gate above the vent such that chemical mixed solution does not contact the second gate to keep the dry chemical supported on the second gate dry.

13. The method according to claim 9 including providing the feed tube with a feed tube end and disposing the first sensor below the feed tube end.

14. A method for mixing dry chemical into a chemical mixed solution comprising:

providing a central controller having microprocessor for sending control signals and receiving signals, providing a hopper having a feed tube with an impeller disposed therein and a motor for rotating the impeller, and providing first and second solenoid actuators operatively associated with first and second solenoid actuated gates that are disposed in the feed tube and disposing the first solenoid actuated gate above the second solenoid actuated gate, with the first and second solenoid actuators and motor being in communication with the central controller, communicating a control signal from the central controller to the first solenoid actuator causing the first solenoid actuated gate to open, communicating a control signal from the central controller to the motor turning the motor on and causing the impeller to rotate, communicating a control signal from the central controller to the first solenoid actuator causing the first solenoid actuated gate to close, communicating a control signal from the central controller to the motor turning the motor off to stop the rotation of the impeller, communicating a control signal from the central controller to the second solenoid actuator causing the second solenoid actuator to open the second solenoid actuated gate, and allowing the dry chemical to flow through the feed tube into the mixing tank, communicating a control signal from the central controller to the second solenoid actuator causing the second solenoid actuated gate to close, providing a inlet process water pipe with a solenoid valve that is joined to the mixing tank and communicating a control signal from the central controller to a solenoid valve causing the solenoid valve to open such that process water flows into the mixing tank, disposing high and low liquid level sensors in the mixing tank that are in communication with the central controller communicating a high level liquid signal from the high liquid level sensor to the central controller and communicating a control signal from the central controller causing the solenoid valve to close to stop the flow of process water into the mixing tank, providing a metering pump and connecting the metering pump to the mixing tank with an outlet pipe and communicating a signal from the central controller to the metering pump turning the metering pump on and pumping a chemical mixed solution out of the mixing tank.

* * * * *